US010446976B2

(12) United States Patent
Yamanashi

(10) Patent No.: US 10,446,976 B2
(45) Date of Patent: Oct. 15, 2019

(54) SHIELD CONNECTOR AND CONNECTOR CONNECTION STRUCTURE

(71) Applicant: Yazaki Corporation, Tokyo (JP)

(72) Inventor: Daisuke Yamanashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/005,500

(22) Filed: Jun. 11, 2018

(65) Prior Publication Data

US 2018/0358740 A1 Dec. 13, 2018

(30) Foreign Application Priority Data

Jun. 12, 2017 (JP) ..... 2017-115437

(51) Int. Cl.

| | |
|---|---|
| ***H01H 13/52*** | (2006.01) |
| ***H01R 13/533*** | (2006.01) |
| ***H01R 13/512*** | (2006.01) |
| ***H01R 13/6581*** | (2011.01) |
| ***H01R 13/502*** | (2006.01) |
| ***H01R 13/6596*** | (2011.01) |

(Continued)

(52) U.S. Cl.

CPC ..... *H01R 13/533* (2013.01); *H01R 13/502* (2013.01); *H01R 13/512* (2013.01); *H01R 13/6581* (2013.01); *H01R 13/6596* (2013.01); *H01R 13/748* (2013.01); *H01R 13/432* (2013.01)

(58) Field of Classification Search

CPC ..... H01R 13/512; H01R 13/5202; H01R 13/5219; H01R 13/533; H01R 13/6581; H01R 13/6596; H01R 13/502; H01R 13/748; H01R 13/432

See application file for complete search history.

(56) References Cited

U.S. PATENT DOCUMENTS 5,890,922 A 4/1999 Buchter et al.
8,167,634 B2 * 5/2012 Fujiwara ..... H01R 13/5202 439/271

(Continued)

FOREIGN PATENT DOCUMENTS

JP 2016-76438 A 5/2016

OTHER PUBLICATIONS

Japanese Office Action for the related Japanese Patent Application No. 2017-115437 dated Jun. 4, 2019.

*Primary Examiner* — Felix O Figueroa
(74) *Attorney, Agent, or Firm* — Kenealy Vaidya LLP

(57) ABSTRACT

A shield connector can easily suppress contact failure between terminal metal fittings due to vibration, and a connector connection structure can include the shield connector. In a large-diameter part in the natural state, a direction dimension passing through a tip of a protrusion is larger than a fastening direction dimension from an abutting part to a first clamping part in the shield case, a fastening member inserted into a fixed part is fastened, and the inner housing is thus hard to vibrate in the shield case. Therefore it is possible to suppress poor contact between a terminal fitting held by the inner housing and a mating terminal fitting. At this time, it is unnecessary to add a new process in order to suppress vibration of the inner housing, easily suppressing a contact failure between the terminal fittings.

12 Claims, 10 Drawing Sheets

(51) Int. Cl.
*H01R 13/74* (2006.01)
*H01R 13/432* (2006.01)

(56) References Cited

U.S. PATENT DOCUMENTS

2013/0017719 A1* 1/2013 Tanaka ..... H01R 9/032
439/587
2018/0301848 A1* 10/2018 Furuya ..... H01R 13/4538

* cited by examiner

SHIELD CONNECTOR AND CONNECTOR CONNECTION STRUCTURE

TECHNICAL FIELD

The present invention relates to a shield to be connected to a device-side connector attached to a casing of an in-vehicle device, and a connector connection structure where the shield connector and the device-side connector are connected.

BACKGROUND ART

Generally, various in-vehicle devices (for example, motors, inverters, etc.) are mounted on a vehicle. In such in-vehicle devices, a large electric current may flow in a main body of a device accommodated in a casing to generate electromagnetic waves, and a metallic casing having an electromagnetic wave shielding function may be used in some cases. At this time, because a connector is provided at an opening of the casing in order to supply electric power to the main body of the device and to transmit and receive signals, electromagnetic waves leak from the opening, and thus a structure has been proposed where a shield connector is fixed to the casing (see, for example, Patent Document 1). In the shield connector described in the Patent Document 1, a shield shell sandwiches a part of the casing with an insertion part inserted into a recess of the casing and a fixing part to be bolt-fixed to the casing. Thus movement of the shield shell with respect to the casing is suppressed.

Patent Document

Patent Document 1: Japanese Unexamined Patent Publication No. 2016-76438

SUMMARY OF INVENTION

Technical Problem

However, in the shield connector described in Patent Document 1, although the movement of the shell with respect to the casing can be suppressed, it was difficult to suppress a vibration of the housing in the shield shell. Vibration of the housing results in a vibration of terminal fitting held by the housing, and such shield connectors were not suitable for the in-vehicle device subject to vibration.

Although such a structure may also be conceivable that the terminal fitting on the device side and the terminal fitting on the shield connector side are firmly fixed using a fixing member, thereby enabling to maintain the electrical connection between the terminal fittings even when vibration is applied, the number of necessary steps increases compared with that simply fitting connectors with each other.

An object of the present invention is to provide a shield connector which can easily suppress contact failure between terminal fittings due to vibration, and a connector connection structure provided with the shield connector.

Solution of Problem

The shield connector of the present invention is a shield connector to be connected to a device-side connector attached to a casing of an in-vehicle device, the shield connector including an inner housing configured to hold a terminal fitting, a shield case including a housing part housing the inner housing, and a fixed part configured to be placed on an outer surface of the casing, through which a fastening member is inserted so as to be fixed to the casing, the housing part includes an abutting part to abut against the outer surface, and an clamping part separating from the outer surface in a fastening direction and sandwiching the inner housing between the clamping part and the outer surface, the inner housing includes at a clamped part sandwiched between the outer surface and the clamping part a protrusion protruding toward the outer surface or the clamping part, and a fastening direction dimension passing a distal end of the protrusion at the clamped part in a state before fastening the fastening member is larger than a dimension from the abutting part to the clamping part in the shield case.

Advantageous Effects of Invention

According to such a connector connection structure of the present invention, by placing the fixed part of the shield case on the outer surface of the casing and allowing the fastening member to be inserted therethrough, the fastening member is fixed, thereby the shield case approaching in the fastening direction with respect to the outer surface of the casing and being fixed. In addition, by the "axial direction" is meant an axial direction of the fastening member such as a bolt. At a clamped part in a natural state (that is, a state before fastening the fastening member), the dimension in the fastening direction that passes through the tip of the protrusion is set larger than the dimension in the fastening direction from the abutting part to the clamping part in the shield case, so that fastening the fastening member allows the protrusion to be compressively deformed.

As a result, the deformed protrusion presses the outer surface or the clamping part, the inner housing hardly vibrates within the shield case. Therefore, it is possible to suppress poor contact between the terminal fitting held by the inner housing and the mating terminal fitting. Further, because the step of fastening the fastening member is a process conventionally required for fixing the shield case to the casing, there is no new process for suppressing the vibration of the inner housing. Therefore, it is possible to easily suppress poor contact between the terminal fittings.

DESCRIPTION OF EMBODIMENTS

Figure 1:
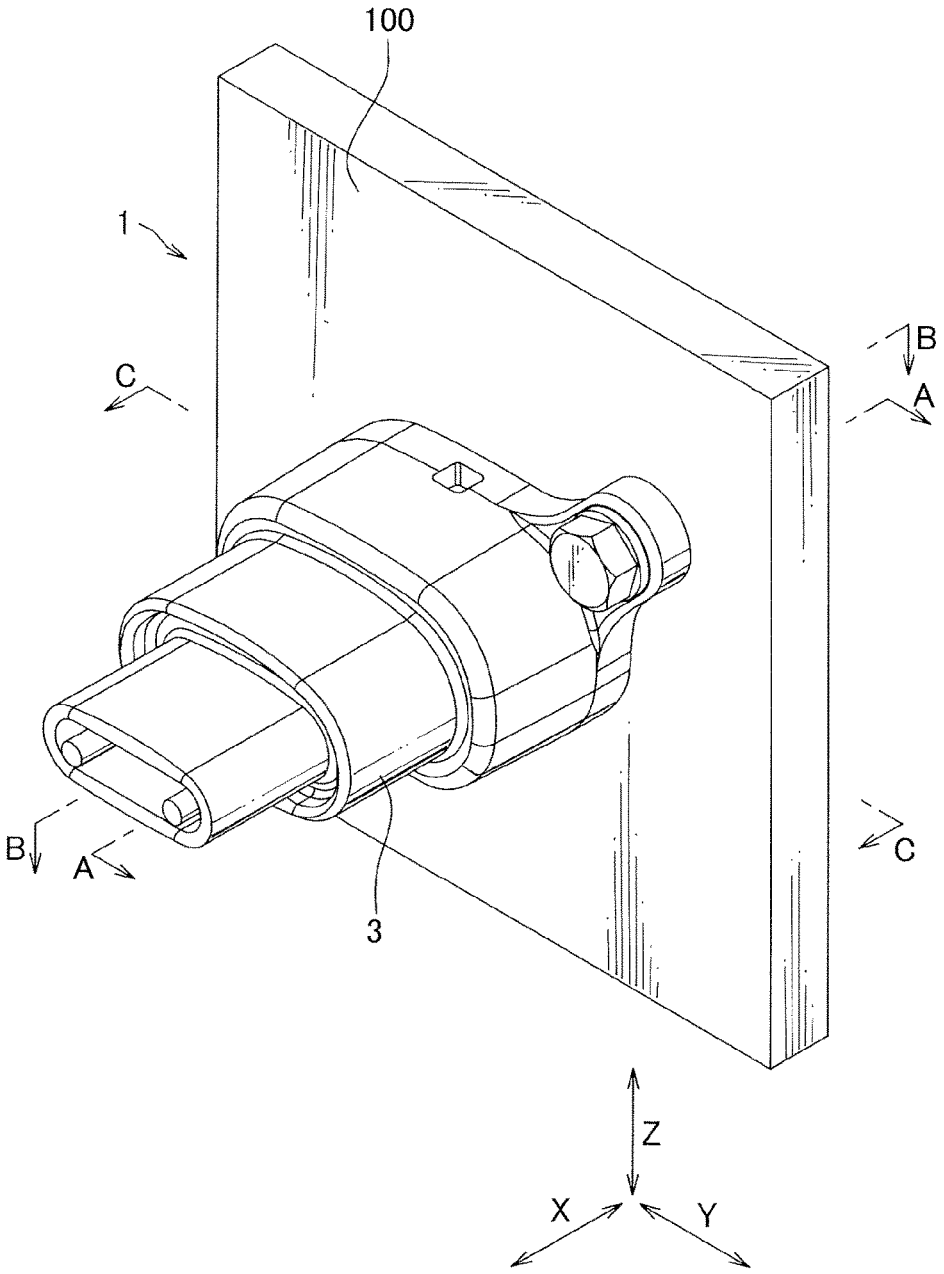
FIG. 1 is a perspective view showing a connector connection structure according to an embodiment of the present invention.
Figure 2:
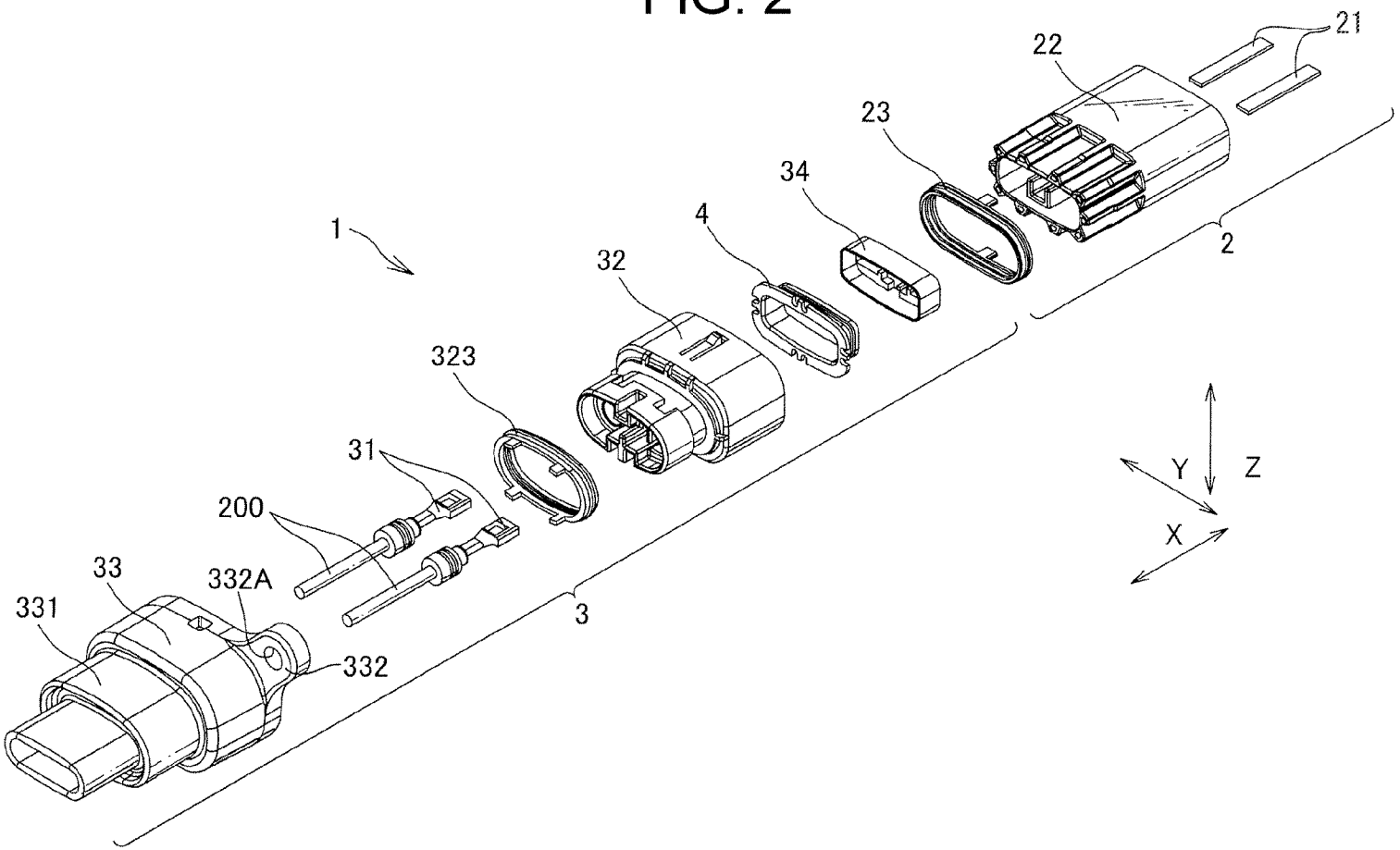
FIG. 2 is an exploded perspective view showing a device-side connector and a shield connector in the connector connection structure.
Figure 3:
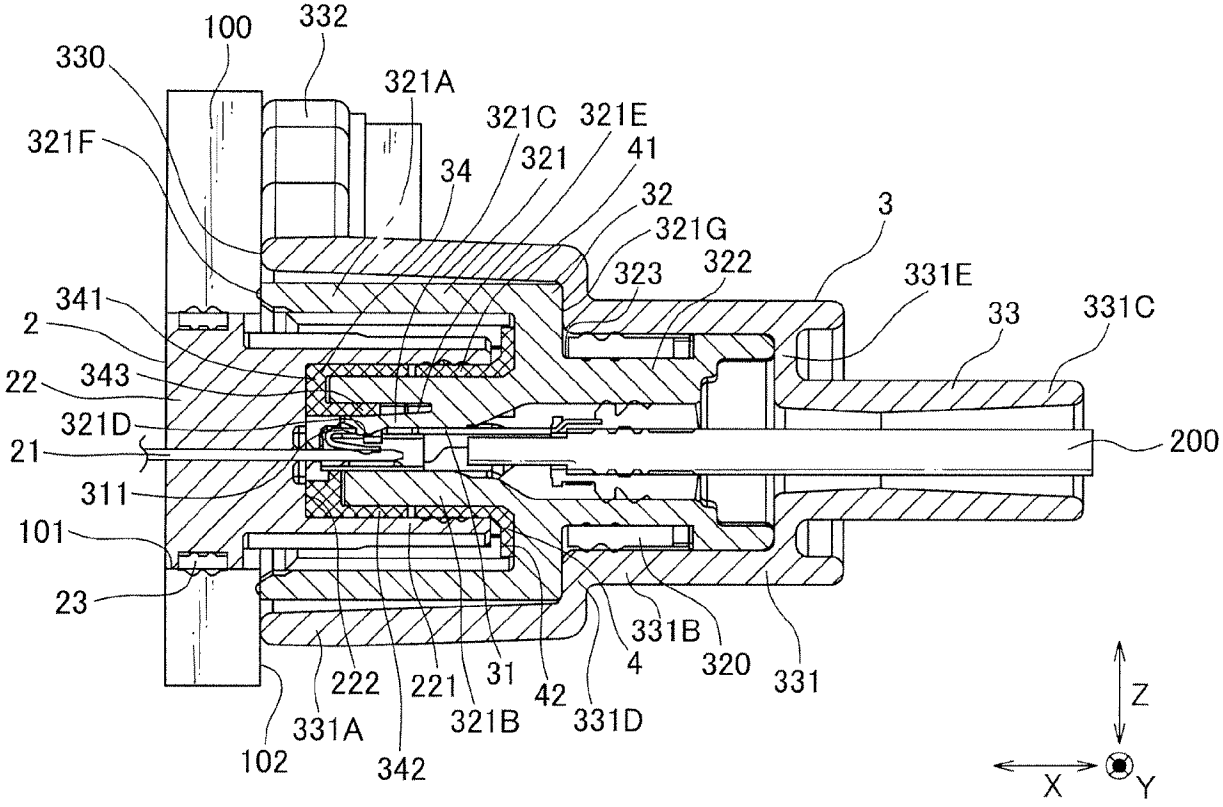
FIG. 3 is a cross-sectional view taken along the line A-A of FIG. 1.
Figure 4:
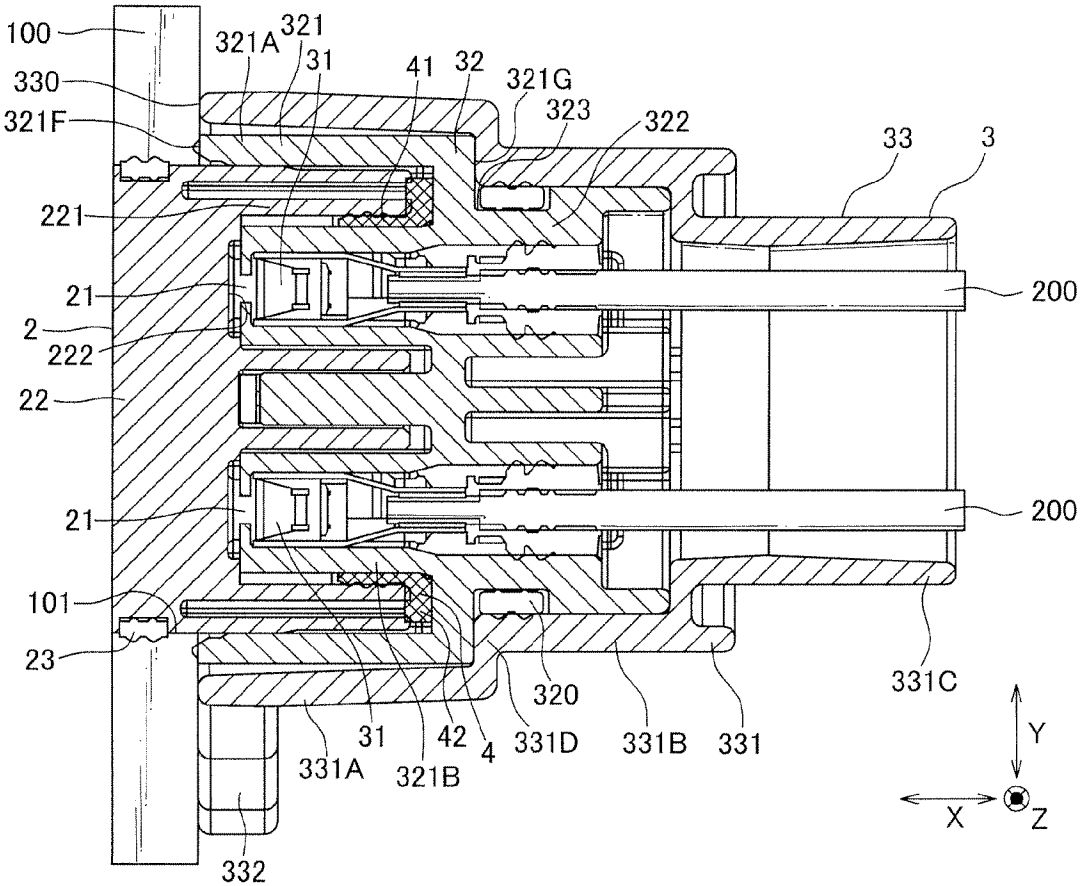
FIG. 4 is a cross-sectional view taken along the line B-B of FIG. 1.
Figure 5:
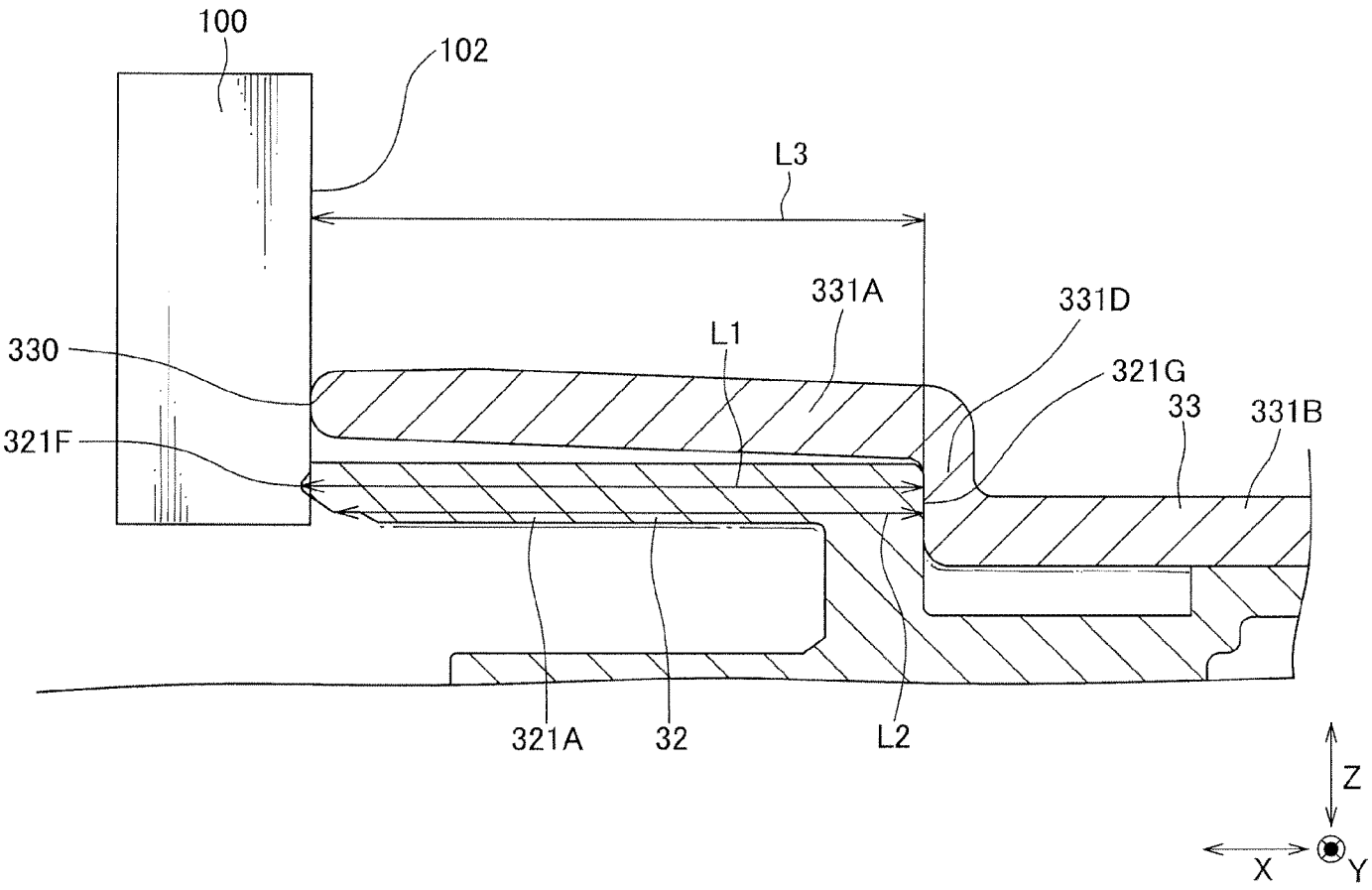
FIG. 5 is a cross-sectional view showing a main part of the device-side connector and the shield connector.
Figure 6:
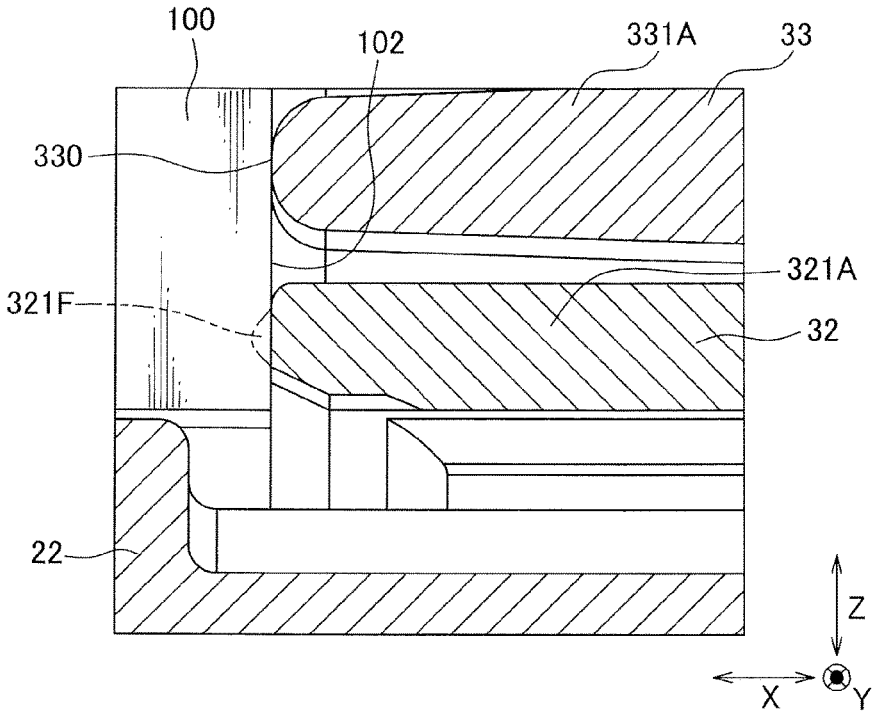
FIG. 6 is a cross-sectional view showing a main part of the connector connection structure.
Figure 7:
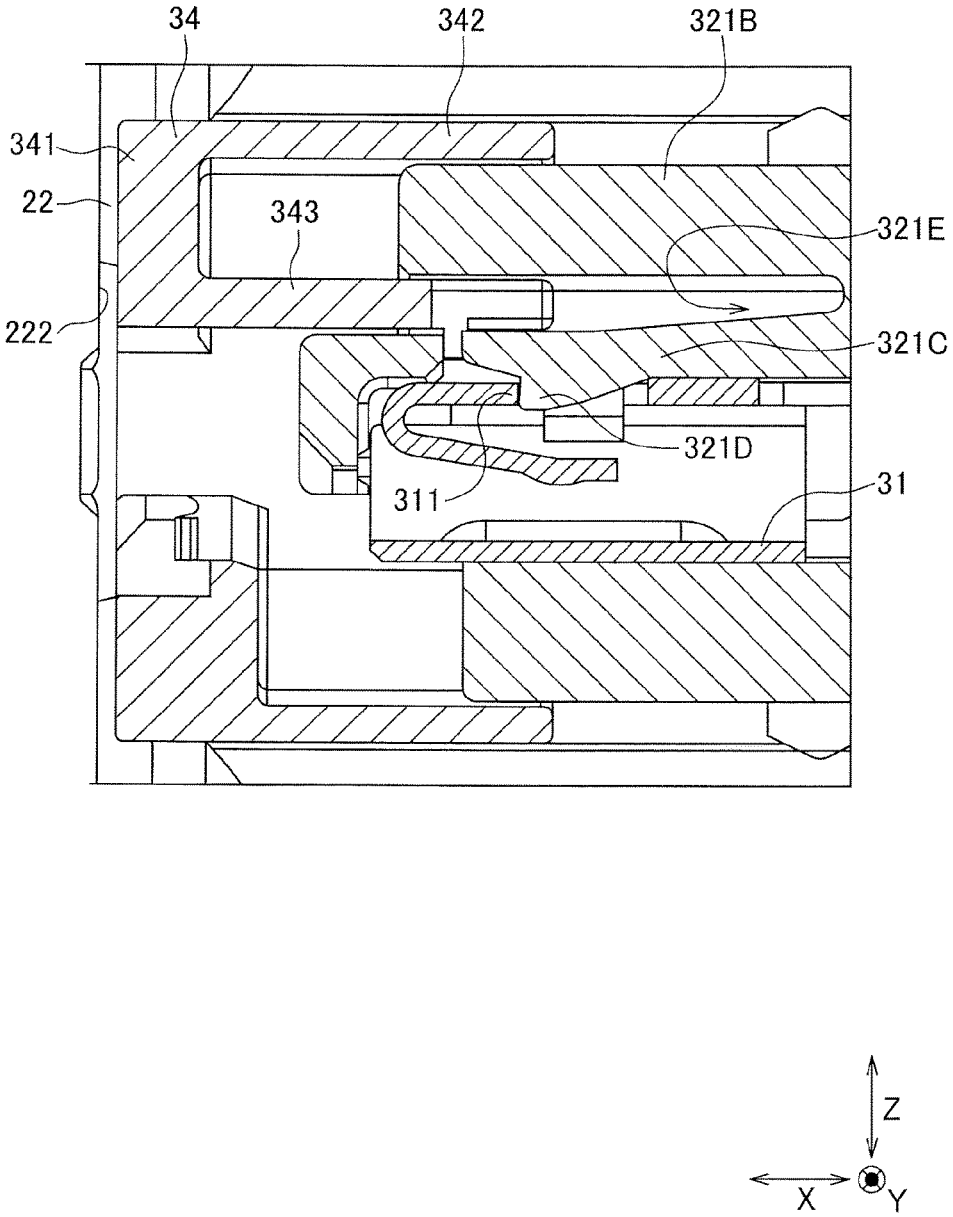
FIG. 7 is a cross-sectional view showing another main part of the connector connection structure.
Figure 8:
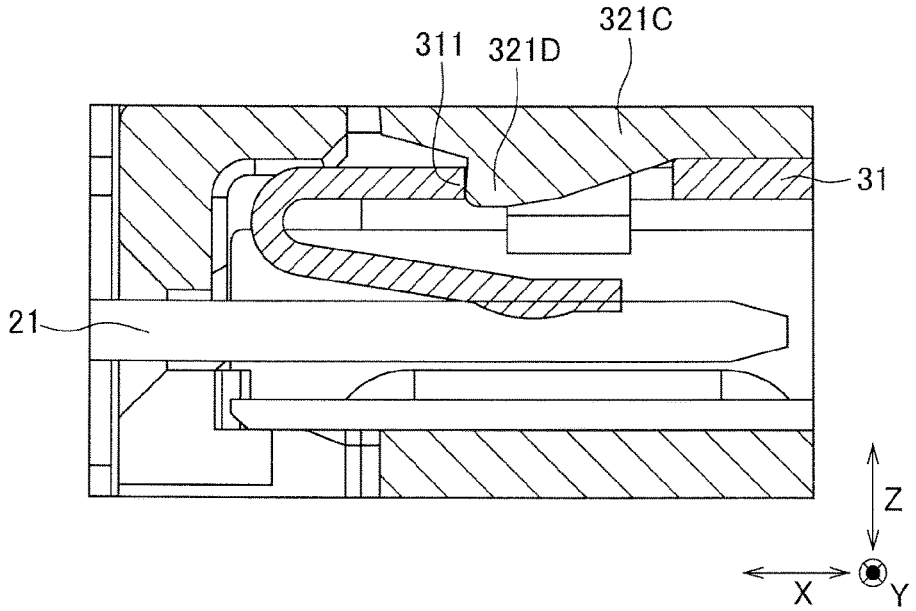
FIG. 8 is a cross-sectional view showing a connection structure between terminal fittings in the connector connection structure.
Figure 9:
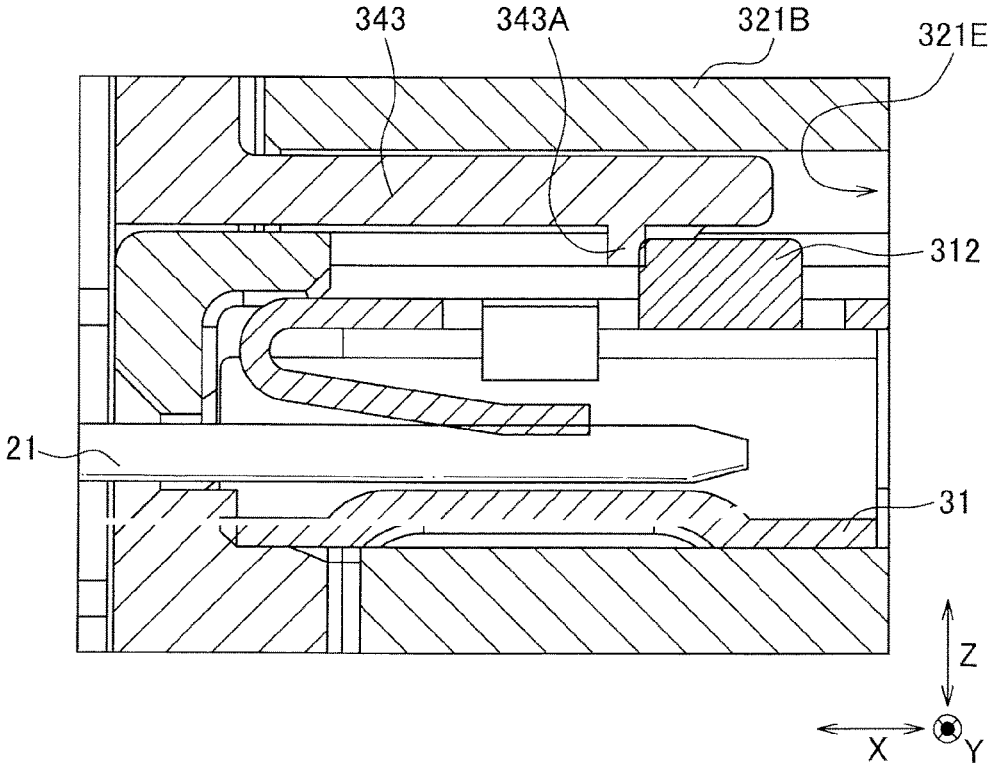
FIG. 9 is a cross-sectional view showing a connection structure between terminal fittings in the connector connection structure.
Figure 10:
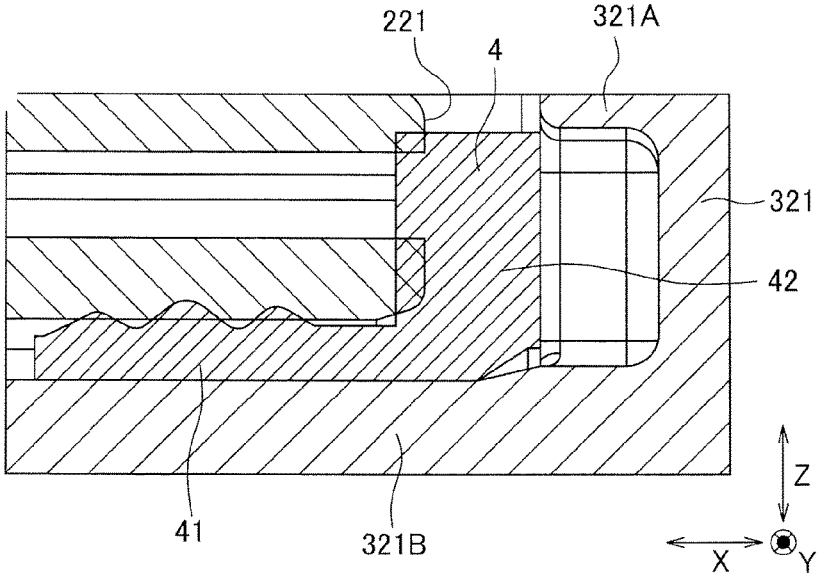
FIG. 10 is a cross-sectional view showing a positional relationship between housings in the connector connection structure.
Figure 11:
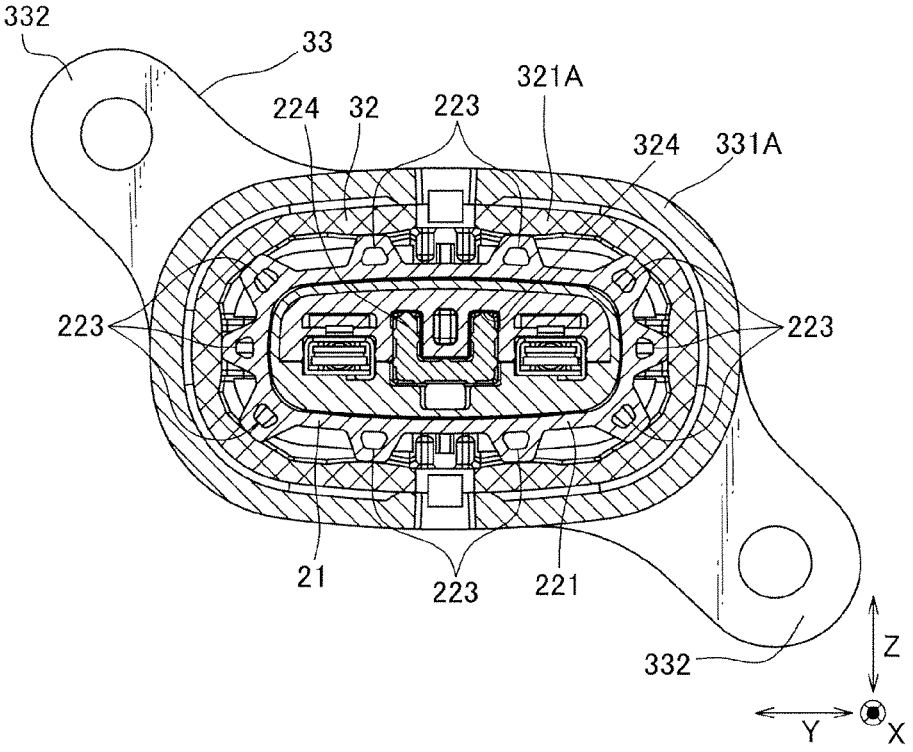
FIG. 11 is a cross-sectional view taken along the line C-C of FIG. 1.
Figure 12:
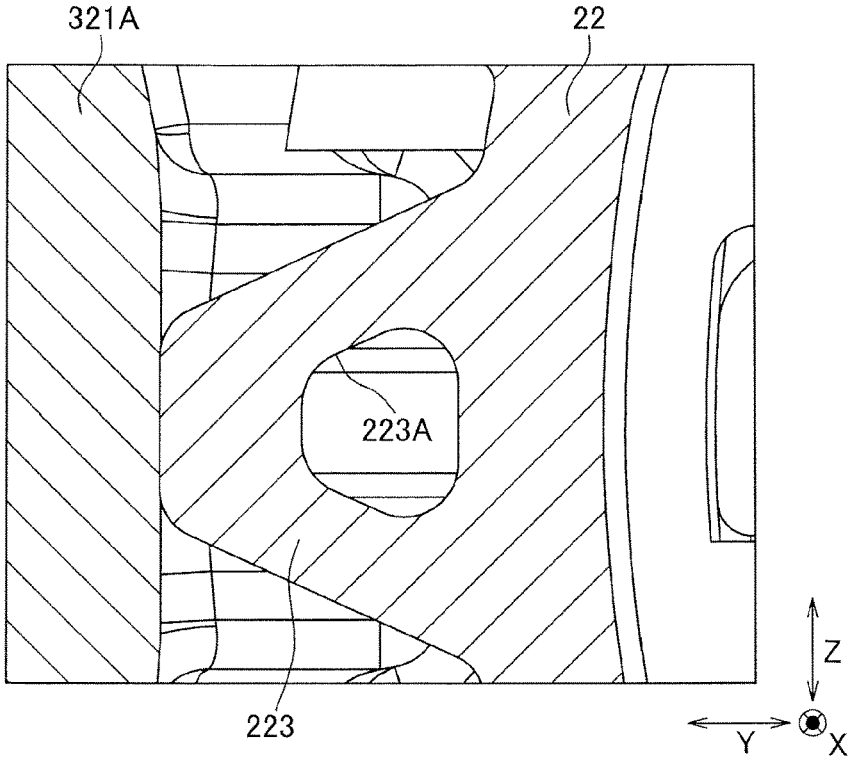
FIG. 12 is a cross-sectional view showing a main part in FIG. 11.
Figure 13:
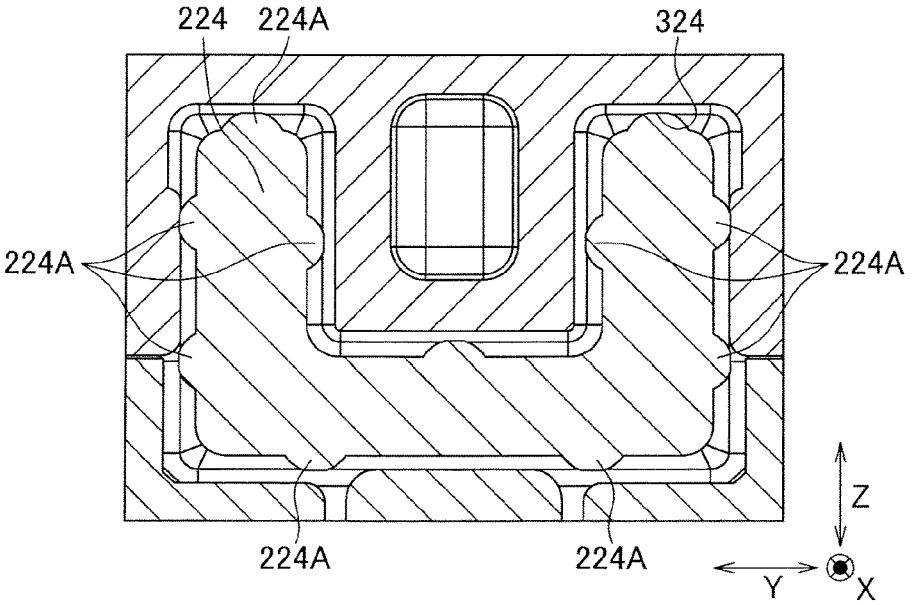
FIG. 13 is a cross-sectional view showing another main part in FIG. 11.

Embodiments of the present invention will be described below with reference to the drawings. FIG. 1 is a perspective view showing a connector connection structure 1 according to an embodiment of the present invention, FIG. 2 is a exploded perspective view showing a device-side connector 2 and a shield connector 3 in the connector connection structure 1, FIG. 3 is a cross-sectional view taken along the line A-A of FIG. 1, FIG. 4 is a cross-sectional view taken along the line B-B of FIG. 1, FIG. 5 is a cross-sectional view showing a main part of the device-side connector 2 and the shield connector 3, FIG. 6 is a cross-sectional view showing a main part of the connector connection structure 1, FIG. 7 is a cross-sectional view showing another main part of the connector connection structure 1, FIGS. 8 and 9 are cross-sectional views showing a connection structure between terminal fittings 21 and 31 in the connector connection structure 1, FIG. 10 is a cross-sectional view showing a positional relationship between housings 22, 32 in the connector connection structure 1, FIG. 11 is a cross-sectional view taken along the line C-C of FIG. 1, FIG. 12 is a cross-sectional view showing a main part in FIG. 11, and FIG. 13 is a cross-sectional view showing another main part in FIG. 11.

The connector connection structure 1 of the present embodiment is the one in which the device-side connector 2 provided with a casing 100 of an in-vehicle equipment and the shield connector 3 are connected to each other. In the present embodiment, the in-vehicle device is for example an inverter, and the casing 100 is made of a metal member having an electromagnetic wave shielding function, and accommodates an inverter main body. By connecting the shield connector 3 with the device-side connector 2, power is supplied to an inverter main body, and signals are transmitted and received. In the present embodiment, a connection direction (terminal connection direction) between the device-side connector 2 and the shield connector 3 is set as X direction, and two directions orthogonal to the X direction are set as Y direction and Z direction, respectively.

The device-side connector 2 includes two band plate-shaped terminal fittings 21 which pass through the through hole 101 of the casing 100 and is arranged in the Y direction, and an insulating resin housing 22 for holding the terminal fitting 21.

The housing 22 blocks the through hole 101 by penetrating it, and protrudes outside the housing 100. A packing 23 is provided between the housing 22 and an inner peripheral surface of the through hole 101. A part of the housing 22 protruding outside the housing 100 is formed such that the center viewed from an outside of the casing 100 is recessedly formed, and includes a cylindrical part 221 and a recess 222. A tip of the terminal fitting 21 is positioned in the recess 222.

The shield connector 3 includes two terminal fittings 31 arranged in the Y direction, a resin-made insulating inner housing 32 holding the terminal fitting 31, a shield case 33 housing the inner housing 32, and a front holder 34 provided at the casing 100 side with respect to the inner housing 32.

The terminal fitting 31 is a cylindrical female terminal crimped to the tip of the electric wire 200, and is electrically connected to each other by inserting the terminal metal fitting 21. The cylindrical terminal fitting 31 has a spring piece bent inward, which makes contact with the inserted terminal fitting 21.

The inner housing 32 has, in order from the housing 100 side, a large diameter part 321 and a small diameter part 322, and a stepped part 323 is formed therebetween.

The large diameter part 321 has a cylindrical part 321A constituting the outer shell thereof, and a cylindrical part 321B provided inside the cylindrical part 321A and extending toward the housing 100 side. When connecting connectors to each other, the terminal holding part 321B is positioned inside the recess 222 of the device-side connector 2, and the cylindrical part 221 of the device-side connector 2 is positioned between the cylindrical part 321A and the terminal holding part 321B of the shield connector 3. That is, the recess and protrusion of the housing 2 of the device-side connector 2 and those of the inner housing 32 of the shield connector 3 are configured to engage each other.

The terminal holding part 321B includes an arm part 321C that flexibly deforms so that the tip thereof moves along the Z direction, and a locking protrusion 321D protruding inward from the arm part 321C, and is formed in a cylindrical shape. The terminal fitting 31 is housed as approaching the housing 100 with respect to the terminal holding part 321B, so that the arm part 321C flexes and deforms outwardly. Once housing of the terminal fitting 31 is completed, the arm part 321C is restored and a to-be-locked part 311 of the terminal fitting 31 is locked by the locking protrusion 321D, so as to suppress disengagement of the terminal fitting 31. At this time, the terminal holding part 321B is provided with a slit part 321E outside the arm part 321C as the arm part 321C can flexes and deforms outwardly. The slit part 321E opens when viewed from the housing 100 side.

At the end of the cylindrical part 321A on the side of the housing 100, a protrusion 321F protruding toward the outer surface 102 of the housing 100 is formed. Further, the large-diameter part 321 has an abutting surface 321G facing a side opposite to the case 100 and is arranged along the YZ plane. The small-diameter part 322 is formed cylindrically to house the electric wire 200, a packing 320 is provided on the outer peripheral surface thereof, which secures sealing property with the shield case 33.

The shield case 33 is formed of a metal member having an electromagnetic wave shielding function, and more hardly deforms than the inner housing 32. The shield case 33 has a cylindrical housing part 331 for accommodating therein the inner housing 32, and a fixed part 332 protruding from the outer peripheral surface at a base end of the housing part 331.

The housing part 331 is formed in three stages so as to become smaller in diameter from the base end side (the casing 100 side) to the distal end side, and includes a first housing part 331A located on the outer side of the large diameter part 321, a second housing part 331B located outside the small-diameter part 322, a third housing part 331C located outside the electric wire 200.

In the shield case 33, the base end of the housing part 331 becomes an abutting part 330 abutting against the outer surface 102 of the casing 100. Between the first housing part 331A and the second housing part 331B, a first clamping part 331D separating from the outer surface 102 and is formed along the YZ plane. The outer surface 102 and the base end of the large diameter part 321 come into contact with each other, the first clamping part 331D and the abutting surface 321G of the large-diameter part 321 come into contact, and the large diameter part 321 of the inner housing 32 is sandwiched from the X direction by the outer surface 102 and the first clamping part 331D, and the large diameter part 321 becomes the clamped part.

Between the second housing part 331B and the third housing part 331C, a second clamping part 331 E is separated from the outer surface 102 and is formed along the YZ plane. While the outer surface 102 and the base end of the large diameter part 321 come into contact, the second clamping part 331E abuts the distal end of the small diameter part 322, and the large diameter part 321 and the small diameter part 3 of the inner housing 32 are sandwiched from the X direction by the outer surface 102 and the second clamping part 331E.

The fixed part 332 has an insertion hole 332A through which a bolt as a fastening member is inserted so as to follow along the X direction and is placed on the outer surface 102 of the housing 100. That is, a bolt is inserted into the insertion hole 332A in the X direction as the fastening direction. In the present embodiment, the shield case 33 has two fixed parts 332, and these two fixed parts 332 are arranged in a direction inclined in the Y direction, but an appropriate number of fixed parts may be provided at appropriate positions in shield case 33 so that the shield connector 3 can be fixed firmly against casing 100.

The bolt inserted into the fixed part 332 is fastened to the outer surface 102 of the casing 100, and therefore the shield case 33 approaches the outer surface 102 in the X direction. Incidentally, in this embodiment, the bolt as a fastening member is fastened to the outer surface 102 of the housing 100, but such configuration is conceivable that the housing 100 does not have a screw hole and the nut is provided on the inner surface, or that a bolt is provided in the housing 100 so as to protrude from the outer surface 102, this bolt is inserted into the insertion hole 332A, and a nut is fastened to the bolt.

The front holder 34 includes a bottom part 341 placed on the casing 100 side with respect to the terminal holding part 321B of the inner housing 32, and a cylindrical part 342 covering the outer peripheral surface at the tip end part of the terminal holding part 321B, and is formed in a bottomed cylindrical shape. The bottom part 341 opens so that the mating terminal fitting 21 can pass through. In the front holder 34, an insertion piece 343 is formed which extends from the bottom part 341 toward the side opposite to the housing 100 and is inserted into the slit part 321E in the cylindrical part 342.

Between the housing 22 of the device-side connector 2 and the inner housing 32 of the shield connector 3, an inter-connector packing 4 is provided. The inter-connector packing 4 has a cylindrical part 41 extending along the X direction, and a flange part 42 extending toward the outer peripheral side at one end of the cylindrical part 41. The cylindrical part 41 is provided so as to cover the outer peripheral surface of the base end part of the terminal holding part 321B. The flange part 42 of the inter-connector packing 4 is placed on the bottom surface of the recess between the cylindrical part 321A and the terminal holding part 321B (the surface facing the outer surface 102 of the casing 100) of the large diameter part 321.

The device-side connector 2 and the shield connector 3 as described above are connected in such a manner that the housing 2 and the inner housing 3 are fitted and the terminal fitting 21 and 31 are thus connected before the bolt inserted into the fixed part 332 is fastened to the outer surface 102 of the housing 100. Such deformation of each part and change in the positional relationship when connecting the connectors will be described below.

First, the deformation of the inner housing 32 will be described with reference to FIGS. 5 and 6. In the large diameter part 321 in natural state, calling the dimension in the X direction from the tip of the protrusion 321F to the contact surface 321G L1, the dimension in the X direction from the base end of the projecting part 321F to the contact surface 321G L2, and the interval between the outer surface 102 and the first clamping part 331D after the bolt fastening L3, the relationship "L1>L3>L2" is established. That is, when the large diameter part 321 to be sandwiched between the outer surface 102 and the first clamping part 331D is called the clamped part, in this clamped part in the natural state, the fastening direction dimension (L1) which passes through the tip of the protrusion 321F is larger than the fastening direction dimension (L3) from the contact part 330 of the shield case 33 to the first clamping part in the shield case 33, and the fastening direction dimension (L2) which passes through the base end of the projecting part 321F is smaller than dimension L3.

Accordingly, as the shield case 33 approaches the outer surface 102 by bolt-fastening, the tip end of the protrusion 321F is compressed and deformed so as to be crushed. Further, as the dimension L2 is smaller than the dimension L3, the tip end of the protrusion 321F is easily deformed.

Next, the operation of the front holder 34 will be described with reference to FIGS. 7 to 9. The bottom part 341 of the front holder 34 is separated from the part 321B before the housing 22 and the inner housing 32 are fitted together, abuts the bottom of the recess 222 of the housing 22 when the housings are fitted together, and comes close to the terminal holding part 321B. At this time, the insertion piece 343 includes at a position not overlapping the arm part 321C in the Y direction a terminal holding part 343A projecting inward. On the other hand, the terminal fitting 31 includes at the position not overlapping with the arm part 321C in the Y direction a protruding piece 312 bent and protruding outwardly.

As the housings are fitted together, and the front holder 34 approaches the terminal holding part 321B, the insertion piece 343 is gradually inserted into the slit part 321E. As a result, the flexure deformation of the part 321C outside is restricted. Further, since the housings are fitted together, the terminal holding part 343A comes into contact with the projecting piece 312 from the housing 100 side, and the terminal holding part 343A is further pressed against the projecting piece 312 by bolt-fastening.

Thereby, the movement of the terminal fitting 31 so as to move away from the housing 100 is restricted by the locking projection 321D, and the movement as approaching is regulated by the terminal holding part 343A. Therefore, the terminal fitting 31 is restricted from vibrating in the X direction with respect to the housing 22 and the inner housing 32.

Next, the deformation of the inter-connector packing 4 will be described with reference to FIG. 10. An end face of the cylindrical part 221 of the housing 22 opens as seen from the outside of the housing 100, and the flange part 42 of the inter-connector packing 4 is disposed so as to close the opening. The flange 42 is clamped between the bottom surface between the cylindrical part 321A and the terminal holding part 321B and the cylindrical part 221, and is compressed by bolt-fastening. At this time, a part of the flange part 42 deforms to cut into the opening on the end face of the cylindrical part 221.

Next, the detailed shape of the housing 22 will be described with reference to FIGS. 11 to 13. The housing 22 has a plurality of protrusions 223 protruding from the outer peripheral surface of the cylindrical part 221. The projection 223 has a shape in which the width decreases from the base end toward the tip, and has a through hole 223A in the center thereof. Accordingly, the protrusion 223 easily deforms when a force is applied from an outside toward an inside of the cylinder relative to the housing 22.

The dimension in the Y direction and the dimension in the Z direction including the protrusion 223 of the housing 22 are set the same level of or slightly larger than the dimension in the Y direction and the dimension in the Z direction of the opening at the cylinder part 321A of the inner housing 32. Therefore, the plurality of protrusions 223 always contacts the cylindrical part 321A, so that the housing 22 is restricted from vibrating in each direction within the YZ plane with respect to the inner housing 32.

In the inner housing 32, a guide part 324 which extends along the X direction and guides a guided part 224 of the housing 22 is formed. In the present embodiment, the guide part 324 is formed into a U-shaped cross sectional hole shape, and a U-shaped cross sectional guided part 224 is inserted, but the shape of the guiding part and the guided part is arbitrary.

The guided part 224 has a plurality of protruding protrusions 224A protruding in the Y direction or the Z direction so as to be brought into contact with the inner surface of the guide part 324. The dimension in the Y direction and the dimension in the Z direction including the protrusion 224A of the guided part 224 are formed somewhat larger than the opening dimension of the guide part 324, and the guide part 224 is press-fitted into the guide part 324. Accordingly, the housing 22 is restricted from vibrating in each direction within the YZ plane with respect to the inner housing 32.

According to this embodiment as described above, there are the following effects. That is, in the large diameter part 321 in the natural state, the fastening direction dimension L1 that passes through the tip of the protrusion 321F is larger than the fastening direction dimension L3 from the abutting part 330 to the first clamping part 331D in the shield case 3, and thus by fastening the fastening member inserted through the fixed part 332, the protrusion 321F is pressed and deformed to press the outer surface 102. As a result, the inner housing 32 hardly vibrates in the shield case 33. Therefore, the terminal fitting 31 held by the inner housing 32 and the mating terminal fitting 21 can be restricted from contact failure. Also, a process of fastening the fastening member is conventionally required in order to fix the shield case 33 to the casing 100, and a new process is no need to be added in order to suppress vibration of the inner housing 32. Accordingly, poor contact between the terminal fittings 21, 31 can be easily suppressed.

Further, in the large-diameter part 321 in the natural state, since the fastening direction dimension L2 passing through the base end of the projecting part 321F is smaller than the fastening direction dimension L3 from the abutting part 330 to the first clamping part 331D in the shield case 3, when fastening the fastening member as described above, the projection 321F is easy to deform and breakage can be suppressed.

In addition, since the protrusion 321F is compressed by the fastening force in the X direction, the inner housing 32 hardly vibrates particularly in the X direction with respect to the shield case 33. In this case, since the connection direction of the terminal fittings 21, 31 and the fastening direction of the fastening member are both in the X direction, in agreement with each other, vibration such that the terminal fittings 21, 31 are inserted and removed can be suppressed.

It should be noted that the present invention is not limited to the above-described embodiment, and other configurations in which the object of the present invention can be achieved are included, and the following modifications and the like are also included in the present invention.

For example, in the above-described embodiment, the protrusion 321F protrudes from the large diameter part 321 toward the outer surface 102 serving as a holding part, but on the large diameter part a protrusion may formed protruding toward the first clamping part 331D, or at least one hand of these protrusions may be provided. Even if the protrusion protruding toward the first holding part 331D is provided, the inner housing 32 becomes hard to vibrate as in the above embodiment, and poor contact between the terminal fittings 21, 31 can be easily suppressed.

Further, in the above embodiment, the large-diameter part 321 sandwiched between the outer surface 102 and the first clamping part 331D serves as a clamped part, and the abutting part against the outer surface 102 of the clamped part and the abutting part against the first clamping part 331D are aligned in the X direction which is the fastening direction, but these abutting parts may not be arranged in the X direction. That is, since the abutting part 330 of the large diameter part 321 contacts the outer surface 102, and the tip end of the small diameter part 322 is in contact with the second clamping part 331E, the large-diameter part 321 and the small-diameter part 322 may be regarded as the clamped part which are sandwiched between the outer surface 102 and the second clamping part 331E. At this time, a protrusion protruding toward the second clamping part 331E may be provided in the small diameter part 322.

Further, in the above embodiment, the connection direction of the terminal fittings 21, 31 and the fastening direction of the fastening member are both in the X direction, that is, the terminal connection direction is oriented in the fastening direction, but the terminal connection direction and the fastening direction may be different from each other. For example, as in the prior art, the fastening direction and the terminal connection direction may be substantially orthogonal to each other. In this case, a part of the inner housing may be sandwiched between the outer surface of the housing and the shield case in the fastening direction.

In addition, the best configurations, methods, and the like for carrying out the present invention are disclosed in the above description, however, the present invention is not limited to this. That is, although the present invention is mainly illustrated and explained for a specific implementation, it is to be understood that without departing from the spirit and scope of the present invention, various modifications can be made by those skilled in the art in the shape, material, quantity, and other details with respect to the above-described embodiment. Therefore, since the description that limits the shape and material disclosed in the above is illustrated in order to facilitate the understanding of the present invention, but does not limit the present invention, and the description with the name of the member with the limitation of some or all of the restrictions on the shape, material, etc. thereof is included in the present invention.

DESCRIPTION OF SYMBOLS

1 connector connection structure
2 device-side connector

21 terminal bracket
22 housing
3 shield connector
31 terminal bracket
32 inner housing
321 large diameter part (clamped part)
33 shield case
330 contact part
331 housing section
331D first clamping part
331F projection
332 fixed part
100 chassis
102 outer surface

The invention claimed is:

1. A shield connector to be connected to a device-side connector attached to a casing of an in-vehicle device, the shield connector comprising:

an inner housing configured to hold a terminal fitting; and a shield case including a housing part housing the inner housing and a fixed part configured to be placed on an outer surface of the casing, through which a fastening member is inserted so as to be fixed to the casing, wherein the housing part includes an abutting part configured to abut against the outer surface, and a clamping part configured to be separated from the outer surface in a fastening direction and to sandwich the inner housing between the clamping part and the outer surface, wherein the inner housing includes, at a clamped part to be sandwiched between the outer surface and the clamping part, a protrusion protruding toward the outer surface or the clamping part, wherein a fastening direction dimension passing a distal end of the protrusion at the clamped part in a state before fastening the fastening member is larger than a dimension from the abutting part to the clamping part in the shield case, and wherein the protrusion is monolithical with the inner housing.

2. The shield connector according to claim 1, wherein the fastening direction dimension passing a base end of the protrusion at the clamped part in the state before fastening the fastening member is smaller than the dimension from the abutting part to the clamping part in the shield case.

3. The shield connector according to claim 1, wherein a terminal connecting direction in which the terminal fitting and a terminal fitting of the device-side connector are connected is oriented in the fastening direction.

4. The shield connector according to claim 2, wherein a terminal connecting direction in which the terminal fitting and a terminal fitting of the device-side connector are connected is oriented in the fastening direction.

5. A connector connection structure, wherein the shield connector according to claim 1 and the device-side connector are connected.

6. A connector connection structure, wherein the shield connector according to claim 2 and the device-side connector are connected.

7. A connector connection structure, wherein the shield connector according to claim 3 and the device-side connector are connected.

8. A connector connection structure, wherein the shield connector according to claim 4 and the device-side connector are connected.

9. The shield connector according to claim 1, wherein the clamped part of the inner housing has a cylindrical part.

10. The shield connector according to claim 9, wherein the clamped part of the inner housing is continuously connected in between the outer surface of the casing and the clamping part of the housing part.

11. The shield connector according to claim 1, wherein the protrusion and the clamped part are unitary.

12. The shield connector according to claim 1, wherein a cross-sectional area of the protrusion is a taper shape.

* * * * *